US005526246A

United States Patent [19]

Liou

[11] Patent Number: 5,526,246

[45] Date of Patent: Jun. 11, 1996

[54] POSITIONING STRUCTURE FOR A PATTERN OF A DECORATIVE LAMP STRING

[76] Inventor: Ching-Chong Liou, P.O. Box 96-405, Taipei 10098, Taiwan

[21] Appl. No.: 375,678

[22] Filed: Jan. 20, 1995

[51] Int. Cl.[6] ..... F21P 1/02

[52] U.S. Cl. ..... 362/252; 362/249; 362/806

[58] Field of Search ..... 362/124, 249, 362/252, 806, 807, 808, 387, 396; 248/314, 316.7, 903

[56] References Cited

U.S. PATENT DOCUMENTS 4,769,749 9/1988 Felski ..... 362/252

4,802,072 1/1989 Kau ..... 362/806

4,962,907 10/1990 Gary ..... 362/249

*Primary Examiner*—Denise L. Gromada

*Assistant Examiner*—Y. Quach

[57] ABSTRACT

A positioning structure for a pattern of a decorative lamp string, which comprises a pattern frame being furnished with a plurality of fastening bases arrange at a regular short distance; each fastening base includes two fastening jaws on both sides of a connection strip on a pattern frame. In and between the two opposite fastening jaws, there is a channel for laying and holding power-supply wires. The fastening jaws each have a hook portion in opposite position, and each hook portion has a curved surface; the outer surface of the fastening jaw also has a round surface. The hook portion has a given resilient force for holding a socket in the pattern frame.

1 Claim, 3 Drawing Sheets

POSITIONING STRUCTURE FOR A PATTERN OF A DECORATIVE LAMP STRING

BACKGROUND OF THE INVENTION

1. Field of the Invention

This invention relates to a Christmas decorative lamp string, and particular to a decorative lamp string formed into a given pattern frame.

2. Description of the Prior Art

A conventional decorative lamp string for Christmas usually has two or more than power-supply wires twisted to connect a plurality of sockets in series; since the sockets are not fastened in a fixed position, the sockets are in a swinging and pendent manner.

In the conventional Christmas decorative lamp string, the pattern frame is made of a metal wire, on which a string of decorative lamps is wound and fastened in place; the number of the sockets and distance among them are usually varied because of the limit of the length and distance of the metal wire.

SUMMARY OF THE INVENTION

The prime object of the positioning structure of the decorative lamp string according to the present invention is to provide a pattern frame for a Christmas decorative lamp string with a regular distance among the lamp sockets. Each socket of the decorative lamp string can be fastened quickly in a fastening base of the pattern frame. Since the space between two fastening bases has a short distance, after a power is applied to the power-supply wires, the light of the bulbs will show a pattern frame immediately.

Another object of the positioning structure of the decorative lamp string according to the present invention is to provide a positioning structure, in which the pattern frame is furnished with a plurality of fastening bases; each fastening base on the connection strip of the pattern frame has two fastening jaws on both sides of the connection strip to extend upwards; between the two fastening jaws, there is a channel for mounting and holding the power-supply wires. The inner and upper portion of the fastening jaws have two opposite hook portions; the inner surface of the hook portion is a curved surface. The hook portion includes an outer curved surface and an inner curved surface so as to provide a fastening force for holding a socket on the pattern frame.

Still another object of the present invention is to provide a positioning structure of a decorative lamp string, in which the space between two fastening bases is a short distance for the sockets and power-supply wires. Before the socket is pressed and fastened in place, the twisted power-supply wires are first laid and mounted in the channel between the two hook portions. After the sockets are fastened in place, the power-supply wires will be mounted in place automatically without moving; simultaneously, the power-supply wires will be laid and limited on the top side of the connection scrip of a pattern frame. The structure of the present invention is described with the accompanied drawings as follows:

DETAILED DESCRIPTION OF THE PREFERRED EMBODIMENTS

Figure 1:
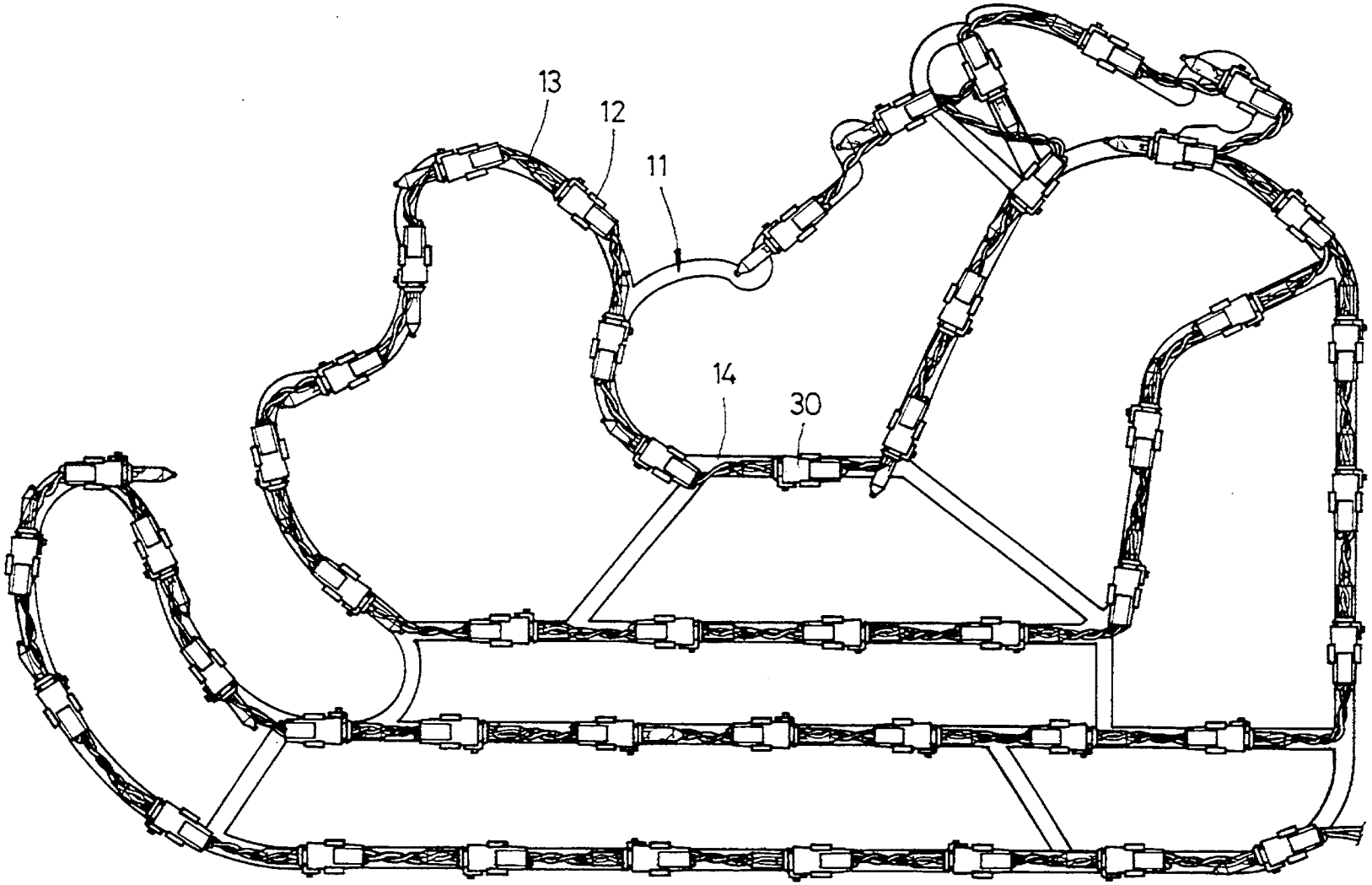
FIG. 1 is a plan view of the pattern frame and a string of decorative lamps according to the present invention.
Figure 2:
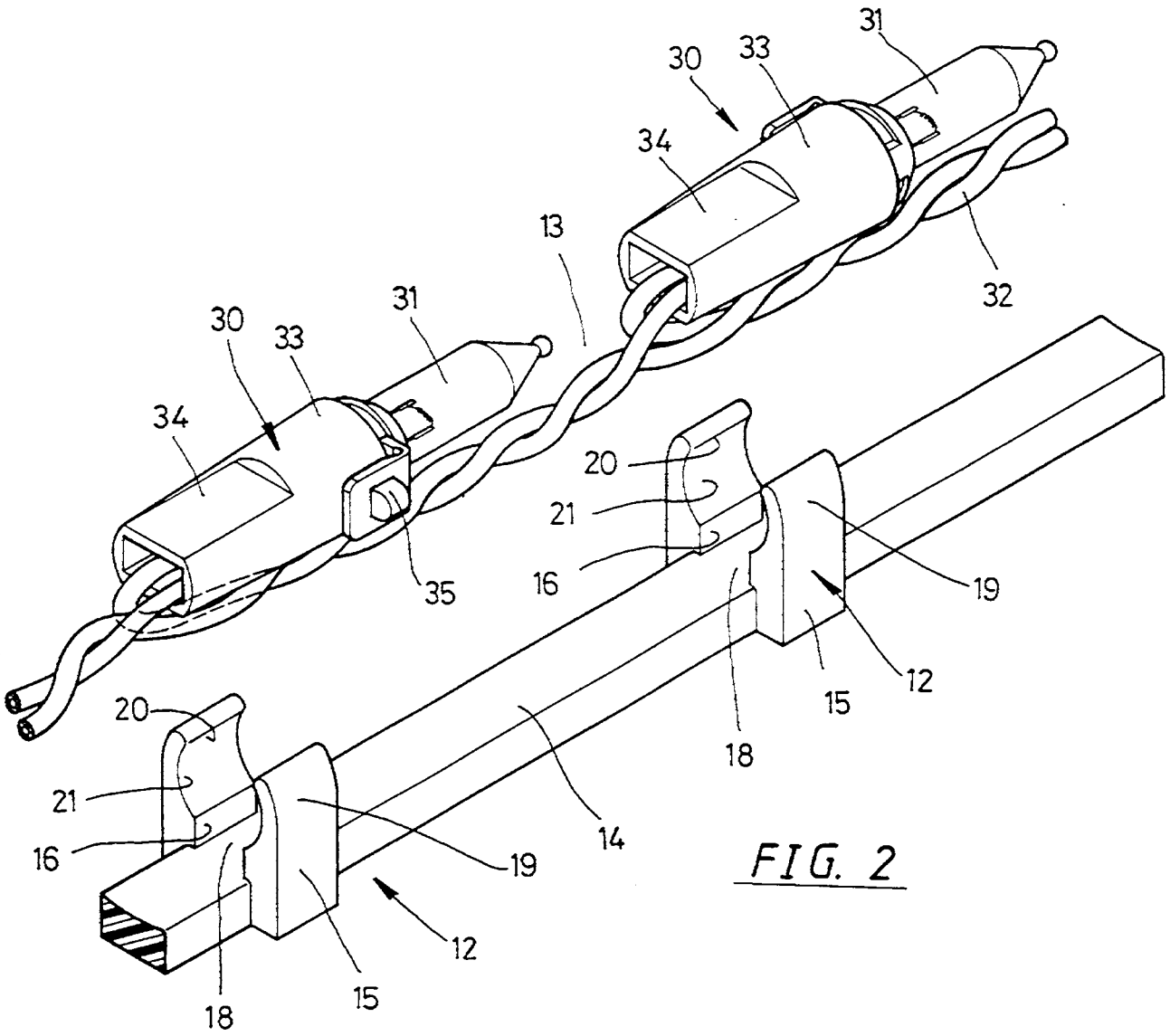
FIG. 2 is a disassembled view of the fastening base and the socket according to the present invention.
Figure 4:
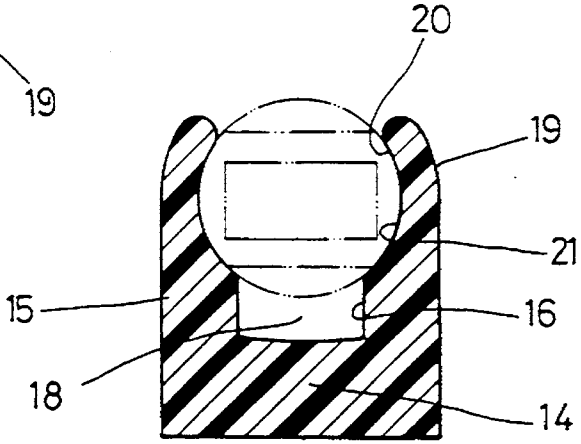
FIG. 4 is a sectional view of the fastening base and the socket after being assembled together according to the present invention.
Figure 3:
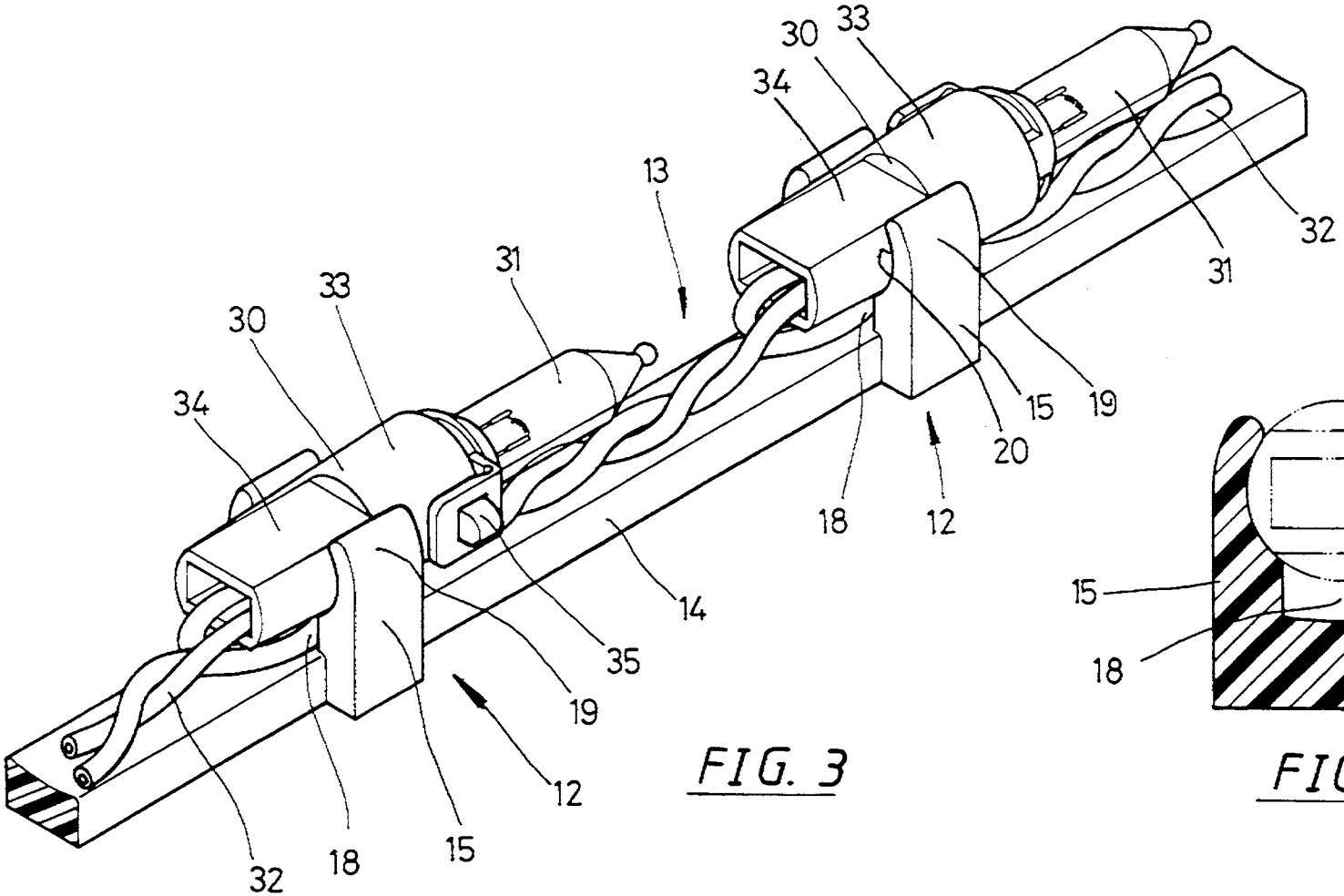
FIG. 3 is a perspective view of the present invention, showing the fastening base and the socket being assembled together by pushing method.

This invention relates to a positioning structure for a pattern of a decorative lamp string as shown in FIGS. 1 to 4.; the present invention comprises a pattern frame 11 molded with a plastic material; the pattern frame 11 includes a plurality of fastening bases arranged at a regular space one another; a connection strip 14 is furnished between two fastening bases 12 as a connection means. Each fastening base 12 has two fastening jaws 15 extended upwards from both sides of the connection strip 14. A channel 18 is provided between two fastening jaws 15; the upper portion of the channel 18 has two opposite hook portions 20. The channel 18 is used for laying and positioning power-supply wires 32. The hook portions 20 are used for fastening a socket 30 of the decorative lamp string 13 in the fastening base 12; each socket 30 is to be fastened in a fastening base 12. As soon as the decorative lamp string 13 is applied with an electric power, the light of lamps will show a pattern frame 11 designed.

The pattern frame 11 can be designed and varied with the festival fashion, such as a particular person or scene. The pattern may be shown by means of an outline, which is formed into shape by means of the connection strip 14 having a given thickness and width between two fastening bases 12. The shape of the connection strip 14 can be varied with the outline of scene or matter. The fastening base 12 in the pattern frame is designed into a short element; before a socket 30 is pressed into the fastening base 12, the twisted power-supply wires 32 must be mounted first in the channel 18. The power-supply wires between two sockets 30 are mounted on the top side of the connection strip 14 of the pattern frame 11.

The sockets 30 fastened in the fastening base 12 are connected with two or more than two wires 32 twisted together in series. In the present invention, two power-supply wires 32 are used and twisted together; one of the two wires 32 is connected in series with a plurality of sockets 30, while the other wire 32 is twisted with the first wire, extending to the end of a series of sockets 30. The front outer surface 33 of the socket 30 is formed into a conic shape, while the rear outer surface thereof has two symmetrical planes 34. The bottom of the socket 30 is used for inserting the power-supply wires 32. The outside of the bulb sleeve of the bulb has a bottom to fit the bulb in place. Between two sockets 30, there is short distance for laying power-supply wires. The length of the twisted power-supply wires 32 is almost equal to the distance between two sockets 30. After all the sockets 30 are mounted in the corresponding fastening bases 12, the power-supply wires 32 will be laid closely on the connection strip 14 of the pattern frame 11.

On the fastening bases 12 of the pattern frame 11, a plurality of base portions of the fastening jaws 15 are provided on both sides of the connection strip 14. Each base portion has two fastening jaws 15 extended upwards; between the two fastening jaws 15, there is an inner plane 16 to form into a channel 18 for mounting the power-supply wires 32 after the socket 30 being pushed in the fastening base 12. The upper portions of the two fastening jaws 15 each have a curved surface 21 to closely fit with the diameter of the outer surface 33 of the socket 30. The upper end of the fastening base 12 extend upwards and outwards to form into two opposite outer surfaces ]9; the upper opening of the two fastening jaws 15 has a space, which is slightly less than that of the mid-outer surface 33 of the socket 30. The fastening jaw 15 has a hook portion 20 from the upper end to the curved surface 21; the hook portion 20 can provide a fastening force for holding the socket 30. The conic outer surface 33 facilitates the socket 30 to be pressed into the opening of the two fastening jaws 15; the conic outer surface 33 of the socket 30 that has a smaller diameter may also be mounted between the curved surfaces 21 of the fastening jaws 15 because of the two fastening jaws 15 having a given resilience.

Since the fastening bases 12 on the pattern frame 11 are arranged at a regular short distance one another, and the power-supply wires 32 between them also have a short length. The conic outer surface 33 of the socket 30 is to be pressed and fastened in front of the fastening base 12. The channel 18 between the two fastening jaws 15 is used for laying and holding the power-supply wires 32 of the decorative lamp string 13. The hook portion 20 above the chancel 18 is to receive and fasten the outer surface 33 of the socket 30. Since the power-supply wires 32 are almost equal in length to the space between two fastening bases 12, the wires 32 are closely held on the top surface of the connection strip 14.

The positioning structure for decorative lamp strip according to the present invention can be mounted with a plurality of sockets 30 in the fastening bases 12 respectively, and the power-supply wires 32 are also laid in the channel 18 almost simultaneously. Between the two fastening bases 12, there is a short distance; as soon as a power is applied to the power-supply wires 32, the light rays will show pattern frame 11 immediately.

The present invention has been described with the aforesaid embodiment, and the features and structure thereof have also been disclosed completely; it is deemed that considerable improvements have been made in terms of the proir art. All the features of the present invention are not anticipated and shown in the prior art, and the structure thereof is also deemed novel.

I claim:

1. A positioning structure for a pattern of a decorative lamp string comprising:

a pattern frame molded with a plastic material and form into a scene by means of an outline connection strip; said connection strip furnished with a plurality of fastening bases arranged at a short and regular spaced interval to one another;

every two said fastening bases being furnished on said connection strip arranged at a short interval, and each of said fastening bases having two base portions extended upwards from one side of said connection strip to form two fastening jaws, each of said jaws having an inner surface and an outer surface, each of said inner surface of said jaws including a plane, and said planes forming a channel for holding and mounting a pair of twisted power supply wires of a socket; said fastening jaws further including a pair of curved surfaces above said channel and which bend inwards slightly toward each other to form an opening of which the distance between said curved surface being smaller than a diameter of said socket; each of said fastening jaws also including an end portion opposite said base portion and formed into a hook portion, said hook portions holding said socket in said fastening base;

a decorative lamp string which including said power-supply wires connected in series with a series of said sockets; said socket including two ends, an outer surface, an inner surface, and a portion of said socket adjacent one end of said socket having two symmetrical planes; said one end of said socket connected with said power-supply wires; said outer surface of said socket at another end being formed into a conic shape and said inner surface of said sockets at said another end defines an opening for holding a lamp bulb; said outer surface of said socket further being pressed and fastened in said fastening base; and said power-supply wires being mounted and held in said channel and on said connection strip.

* * * * *